US005350170A

United States Patent [19]

Emigh et al.

[11] Patent Number: 5,350,170

[45] Date of Patent: Sep. 27, 1994

[54] ROLLER GAP SETTING SYSTEM

[76] Inventors: Jon Emigh, 7050 Mt. Aukum Rd. #5, Somerset, Calif. 95684; Motaz Qutub, 11044 Cobblestone Dr., Rancho Cordova, Calif. 95670

[21] Appl. No.: 95,692

[22] Filed: Jul. 21, 1993

[51] Int. Cl.[5] ..... B65H 5/00

[52] U.S. Cl. ..... 271/273; 198/624

[58] Field of Search ..... 271/272, 273, 274; 198/624

[56] References Cited

U.S. PATENT DOCUMENTS

| | | | |
|---|---|---|---|
| 3,241,665 | 3/1966 | Erk | 271/273 |
| 3,516,655 | 6/1970 | Schmeck . | |
| 4,032,133 | 6/1977 | Steffens et al. . | |
| 4,223,882 | 9/1980 | Stocker . | |
| 4,225,128 | 9/1980 | Holyoke . | |
| 4,403,981 | 9/1983 | Wuthrich . | |
| 4,586,704 | 5/1986 | Lehmann et al. . | |
| 4,621,966 | 11/1986 | Luperti et al. . | |
| 4,750,853 | 6/1988 | Soest et al. | 198/624 |
| 4,843,802 | 7/1989 | Noll . | |
| 4,944,131 | 7/1990 | Gough . | |
| 5,045,039 | 9/1991 | Bay . | |
| 5,082,255 | 1/1992 | Brigante et al. . | |

FOREIGN PATENT DOCUMENTS

| | | | |
|---|---|---|---|
| 0111337 | 8/1980 | Japan | 271/273 |
| 404209151 | 7/1992 | Japan | 271/272 |
| 8302348 | 7/1983 | World Int. Prop. O. | 271/273 |

*Primary Examiner*—H. Grant Skaggs
*Attorney, Agent, or Firm*—James M. Ritchey

[57] ABSTRACT

For use in transporting a packet containing from one to a plurality of pages, a dynamic roller positioning system for adjusting a packet receiving gap between two rollers. Comprising the system is a pair of rollers with each roller having a packet contacting surface and the packet receiving gap separating the surfaces, gap setting actuators for setting the paired rollers by steps to a selected gap dimension, and a control system for setting the actuators for the number of pages in each packet.

19 Claims, 7 Drawing Sheets

ROLLER GAP SETTING SYSTEM

BACKGROUND OF THE INVENTION

1. Field of the Invention

A dynamic roller gap setting system for a paper folder is related. Disclosed is a standard buckle folder adapted with a dynamic folding mechanism utilizing twin actuators that rapidly and reliably adjusts the rollers within the folder to receive multi-page packets of paper that vary in the number of included pages.

2. Description of the Background Art

Numerous types of buckle folders with modifications and variations exist is the mailing industry. However, the prior folders have rollers that lack the ability to automatically and rapidly adapt in a reliable manner to receive multi-page packets that essentially randomly vary in the number of pages with in a packet.

Generally, the buckle folder works by receiving a packet of pages between rollers and the packet progresses into a folding cage or gate. When the packet reaches the set stop point for the folding cage, the front edge of the packet stops even though the trailing edge of the packet is still being fed into the folder. The continuous feeding causes the packet to buckle and be forced down through the next set of folding rollers which crease the packet at a point determined by the folding gate set stop point. A control system drives the direction of rotation of the rollers. Preferably, it is this type of buckle folder or equivalent that is modified to accept the subject system.

The standard buckle folder comes with rollers that have an adjustable gap, however, the gap adjustments are very slow and prevent the rapid processing of packets with variable numbers of pages. The rollers are adjusted by a rigid linkage that comprises a screw mechanism that has a knob for setting the roller gap. Usually, a group of packets all having the same number of pages is process in bulk and then the knob is turned to set the gap for another group of packets with a different number of pages.

Specifically, U.S. Pat. No. 3,516,655 discloses a method and means for fold adjustment in a buckle chute folding machine. Variable fold lengths are generated by this apparatus, but roller spacings are virtually fixed to receive a set number of pages to fold.

U.S. Pat. No. 4,032,133 teaches a buckle folder that incorporates rollers having adjustable gaps. Adjusting screws are fastened to appropriate rollers and hand rotated to pre-select desired spacing values.

Described in U.S. Pat. No. 4,223,882 is an automatic in-line mailing system. Included in this system is a folder that receives sheets generated from a cutter utilizing a roll of forms.

A folding machine is communicated in U.S. Pat. No. 4,225,128. Similar to U.S. Pat. No. 4,032,133 above, the apparatus related here comprises a plurality of main rollers and adjustable roll combinations. Each roll may be independently adjusted by means of finger activated screw mechanisms.

U.S. Pat. No. 4,403,981 discusses a folding machine that comprises a several rollers and a cartridge that turns about an axis. This device permits semi-rigid cards to be included within the final folded packet.

Explained in U.S. Pat. No. 4,586,704 is a buckle-type sheet folder. The design of this apparatus permits different folding patterns to be generated by activating sheet stops and deflectors. A console is included in the machine that activates motors to drive the sheet stops and deflectors.

U.S. Pat. No. 4,621,966 reveals a shingle compensating device. A stack of forms is forced into an off-set (shingled) stack for delivery to a folder. Due to the off-set nature of the stack, the folder is then capable of folding the shingled stack into an aligned final version.

U.S. Pat. No. 4,843,802 discloses an inserting apparatus. Various fixed rollers are employed in the folding and inserting process.

A paper folding apparatus is presented in U.S. Pat. No. 4,944,131. Included is first signal when a normal insert is introduced between two receiving rollers (one has a fixed rotational axis and the other a movable rotational axis) and a second signal when two or more inserts are introduced between these rollers. The first signal causes the machine to halt the progress of the first insert until a second insert has been positioned in a leading fold of the first insert. The second signal stops the machine and initiates on the control panel of the machine that a double insert has occurred. A simple optical detector is attached to the movable roller and notes one of two possible positions for signaling a double insert.

U.S. Pat. No. 5,045,039 discloses a program controlled sheet folding apparatus for folding large sheets into predetermined formats. To produce a desired folding pattern, several rollers are present and the rotational directions of these rollers are controlled by a programmable means.

Described in U.S. Pat. No. 5,082,255 is a sheet processing apparatus. that has a roller that is positioned by a single screw jack drive on each end of the roller. A motor, output shaft, pulley gears, and timing belt are included in the roller width changing structure.

SUMMARY OF THE INVENTION

An object of the present invention is to provide a reliable system for quickly setting the gap between rollers in a buckle folder.

Another object of the present invention is to disclose an actuator system for setting the spacing gap between rollers that rapidly responds to the number of pages of a packet that is entering between the rollers.

A further object of the present invention is to furnish a system of controlling the spacing gap between rollers that responds quickly and reproducibly to a signal that indicates the number of incoming pages in a packet.

Still another object of the present invention is to supply a roller gap setting system that relies on actuators to quickly size the roller gap to accommodate an incoming packet having a variable number of pages.

For use in transporting a packet containing from one to a plurality of pages, disclosed is a dynamic roller positioning system for adjusting a packet receiving gap between two rollers. The subject device comprises a housing that is usually a buckle folder. A first roller is mounted in the housing and has a fixed position for rotation. The first roller has an outer packet contacting surface. Additionally, a second roller is mounted in the housing and has a variable position for rotation with an outer packet contacting surface and a central axle with first and second ends. A gap with variable dimensions separates the first and second roller outer packet contacting surfaces. Normally, more than one such pair of first and second rollers are found within a buckle folder that has been modified with the subject invention.

A gap setting means is provided for setting the first and second rollers to a selected gap dimension by steps. Preferably, the gap setting means comprises a reference base for aligning the gap setting means and an adjustment lever with first and second ends and a pivot attachment point. The adjustment lever is pivotally secured to the reference base at the pivot attachment point. A linkage runs between the adjustment lever second end and the second roller, whereby when the adjustment lever pivots on the reference base the gap dimensions are set by steps. Means are included for positioning or stepping the adjustment lever to set the gap dimensions as instructed by the control means.

Control means are provided for actuating the gap setting means for each packet. The control means is generally a computer or equivalent system that utilizes a database that presents a page count for each packet and signals the gap setting means to produce an appropriate gap dimension to receive that the packet.

Other objects, advantages, and novel features of the present invention will become apparent from the detailed description that follows, when considered in conjunction with the associated drawings.

DESCRIPTION OF THE PREFERRED EMBODIMENT

Referring now to Figs. 1 and 3–8, there is shown a preferred embodiment of a roller gap setting system. The subject system is intended for use in any apparatus that transfers a packet containing a variable number of pages from one location to another location. Commonly, the subject system is put to use within a standard buckle folder. Although the buckle folder is used as an example in this disclosure, it is stressed that the subject system may be employed with any apparatus that transports packets containing variable numbers of pages.

Figure 2:
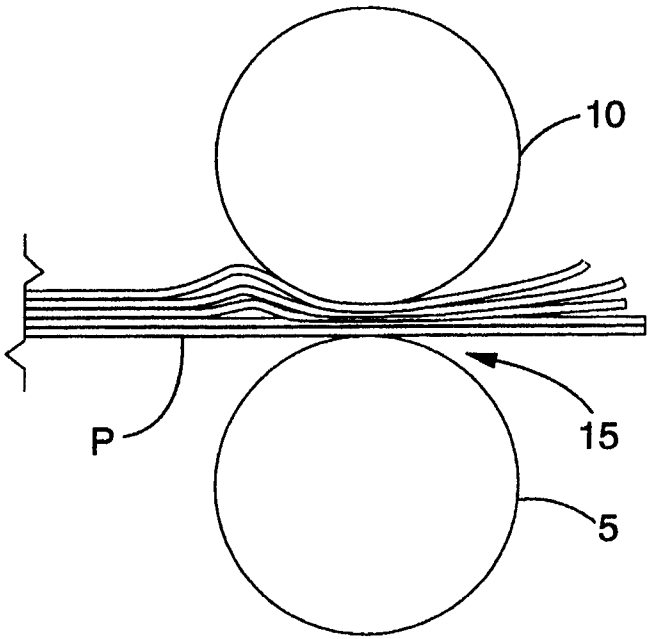
FIG. – 2 PRIOR ART
FIG. 2 is a side view of a pair of rollers showing the prior art with incorrectly set gap and a packet of pages skewing or misaligning between the rollers.
Figure 1:
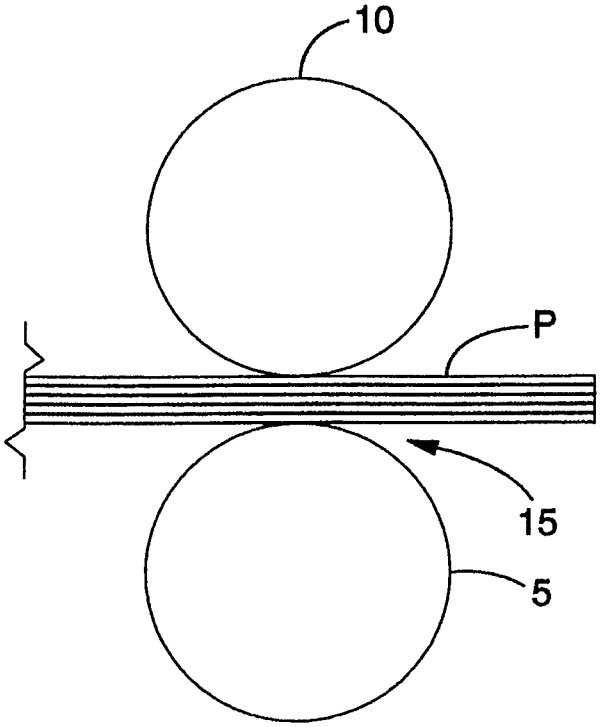
FIG. 1 is a side view of a pair of rollers showing a correctly set gap and a packet of pages passing between the rollers.

For a standard buckle folder to work properly when folding multi-page packets, the gap between paired rollers within the folder must be opened up to the point where the rollers have a firm grip on the packet (see FIG. 1), but not so hard that the packet is being deformed from excess pressure from the rollers (see FIG. 2). More specifically, whenever a packet containing a variable number of pages, one page or more, passes between a pair of gripping rollers the separation gap between the rollers must be set to a dimension to apply sufficient pressure to cause a proper transfer the intact packet. As seen in FIG. 1, a first roller 5 with a fixed position for rotation is separated from a second roller 10 with a variable position for rotation by a packet receiving gap 15 that is set to any selected gap dimension. Each roller 5 and 10 has a packet contacting surface. As seen in FIG. 2, if too much pressure is applied by the rollers by having the gap dimension too small for the transported packet P, the rollers cause the pages within the packet P to misalign or skew, thereby possibly jamming or slowing the mechanism employing the rollers 5 and 10.

Figure 3:
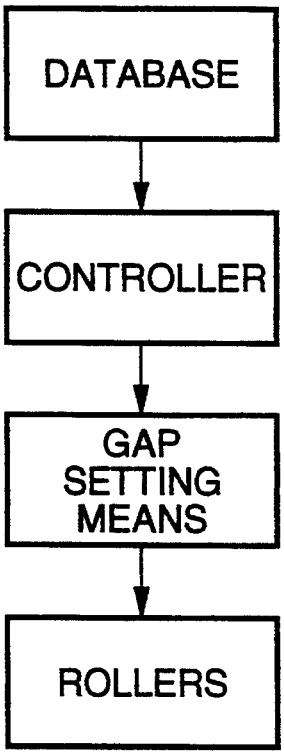
FIG. 3 is a flow diagram depicting the system actions of the subject invention.

FIG. 3 illustrates a flow diagram of the subject system. A database holds information on the number of pages that each packet contains. This database is generated in any standard manner that is now know or later developed. The database can contain such information as billings data, mailing data, banking information, product and services use data, and the like, Often the packets are statements or bills for services or products rendered. The packets may contain single or multiple pages of computer printed materials, fliers, advertisements, notifications, and like items. The database is in any appropriate form such as magnetically stored data on suitable medium, permanent or volatile forms, and the like.

Also seen in FIG. 3 is a controller, usually a computer, microprocessor, or similar device, that utilizes the database to evaluate and actuate, based on the number of pages in the incoming packet, a suitable roller gap setting for each set of rollers that will receive the packet. Desired page count ranges for a particular gap setting are determined and recorded in the controller by standard means. Normally, one gap setting provides suitable roller gripping pressure for packets having from one to five pages, a second gap setting provides suitable roller gripping pressure for packets having from six to ten pages, and a third gap setting provides suitable roller gripping pressure for packets having from eleven to fifteen pages, These page ranges are exemplary only and other page ranges are contemplated to be within the realm of this disclosure.

The controller signals, by standard means (usually electronic, but mechanical means are possible), the gap setting means to adjust the rollers by steps to receive an incoming packet. The gap setting means of the subject invention utilizes a stepped (or digital type adjustment) adjustment scheme and is extremely rapid, the gap setting may vary with each incoming packet, as determined by the controller. In the context of this disclosure, the term "rapid" for the gap setting or stepping ability implies that gap adjustments or steps be made from one setting to another setting in about 50 milliseconds to about 1000 milliseconds, usually about 100 milliseconds to about 500 milliseconds, and preferably about 250 milliseconds. The time span required is determined by the speed of the printing system for the included pages and the packet feeding system.

Figure 4:
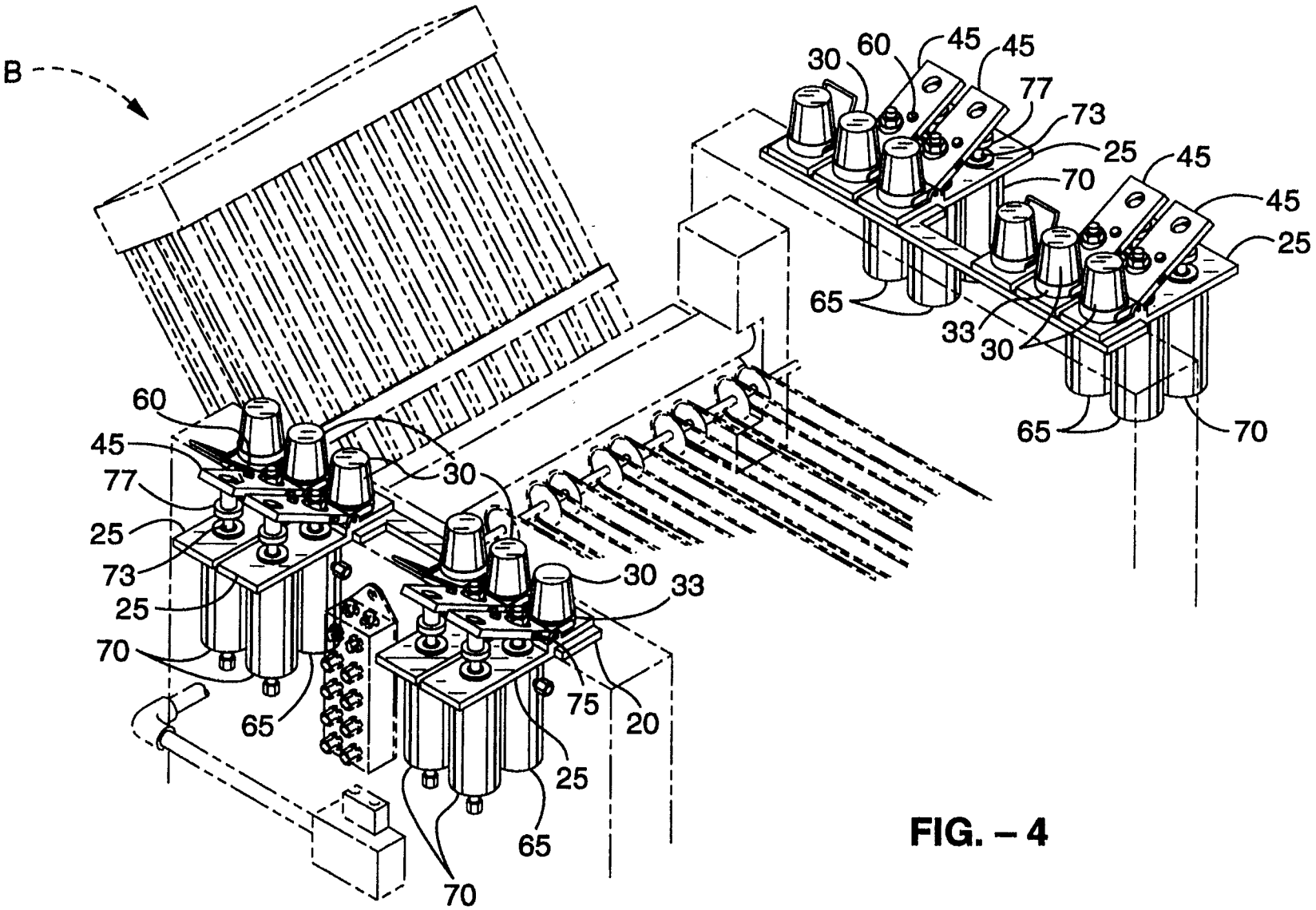
FIG. 4 is a perspective view of a buckle folder adapted and modified with the subject invention.

The subject gap setting system may be utilized on any set of paired rollers, however, a particularly useful application is with a buckle folder. As seen in FIG. 4, the standard buckle folder B is adapted or modified to accept the subject system. To transfer packets of paper from one location to another within, into, or out of the folder B or other equivalent device, several sets of paired rollers exist. In the standard buckle folder B the roller gap setting are determined by a threaded mechanism (an analog type adjustment) that is manually operated and is thus far to slow to be of practical use in high speed folding of variably paged packets. However, the standard buckle folder B gap setting manual means are modified in the subject invention to include a controlled selected mechanism that rapidly adjusts the roller gap settings.

As seen in FIGS. 4–8, the buckle folder B has a side plate 18 of a housing. Although other locations on the folder housing are possible, preferably, the side plate 18 is fitted with an adjustment reference plate 20 that stabilizes and references the movement of the variable position roller 10. A mounting bracket 25 is secured to the reference plate 20 and the combined pair (20 and 25) is termed the reference base which is employed for aligning the gap setting means of the subject invention. To adjust the position of the variable position roller 10, an adjustment knob 30 is provided. Below the adjustment knob 30 is notched collar 33. A rigid linkage 35 is slidably mounted in the reference base and connects the adjustment knob 30 and collar 33 to the variable position roller 10 by one end of a central axle 40 that extends through the variable position roller 10. Resilient means, usually a suitable affixed spring, forces the linkage 35 (with associated knob 30 and collar 33) into a position in which the paired rollers 5 and 10 have a minimum gap 15 separation. In the minimum gap position (see FIG. 7) the collar 33 approaches or contacts the reference base. To create reproducibly a gap that has a relatively uniform dimension along the surfaces of the paired rollers 5 and 10, it must be noted that both ends of each variable position roller's axle 40 are connected to a similar gap setting means (directly to the linkage 35) and are controlled or stepped in unison by the control means.

For stepping the gap 15 into a desired spacing, the gap setting means includes (in addition to the already mentioned reference base and linkage 35) an adjustment lever 45 with first (distal to the linkage 35) and second (proximal to the linkage 35) ends and a pivot attachment point 50. The lever 45 is pivotally secured at a pivot mount 55 on the reference base by the pivot attachment point 50. The first end of the lever 45 fits into the notch of the notched collar 33. When the lever 45 is pivoted by a lever positioning means, as directed or instructed by the control means, on the reference base the gap dimensions are set by a sliding movement of the associated linkage 35.

Comprising the adjustment lever positioning means are means for setting the lever 45 to a stop position against said reference base and an actuator means for pivoting the lever 45 to set the gap dimensions as instructed by the control means. Usually, the means for setting the lever 45 to a stop position against the reference base comprises a lockable screw 60 mounted in or to the lever 45. Other equivalent stop means are considered to be within the realm of this disclosure. Generally, the screw 60 is positioned proximate the lever first end or between the lever 45 first end and the pivot point 50.

Generally, comprising the lever actuating means is a plurality of actuators that may be solenoids or equivalent means such as stepper motors or hydraulic and pneumatic means and the like secured to the reference base. The actuating means generates the stepping action that rapidly shifts the dimension of the gap 15 between the controller instructed spacings. Preferably, the plurality of actuators comprises a first actuator 65 (proximal to the pivot point 50) and second actuator 70 (distal to the pivot point 50). Both the first and second actuators are mounted to the reference base. Clearly, more than two actuators may be employed in the subject invention and arranged in a manner to increase the number of possible stepping positions for the gap dimension.

As seen in FIGS. 4–8 the first 65 and second 70 actuators have a plungers 72 and 73. Usually, the terminal ends of both plungers 72 and 73 extend through receiving apertures in the lever 45. When actuated by the controller to space appropriately the roller gap 15 to receive an incoming packet, the first plunger 72 exerts a upward (away from the reference base) pivoting force on the lever first end. The first plunger 72 is pulled into the body of the first actuator 65 by the controller signal actuating the actuator's 65 driving force (magnetic field, pressurized air or fluid, and the like, depending on the exact nature of the employed actuator). To exert the pivoting force on the lever 45, the lever 45 is fastened to the first actuator's plunger 72 by a hinge means comprising a pin 75 extending from the plunger 72 into a receiving slot 76 in the lever 45.

Figure 5:
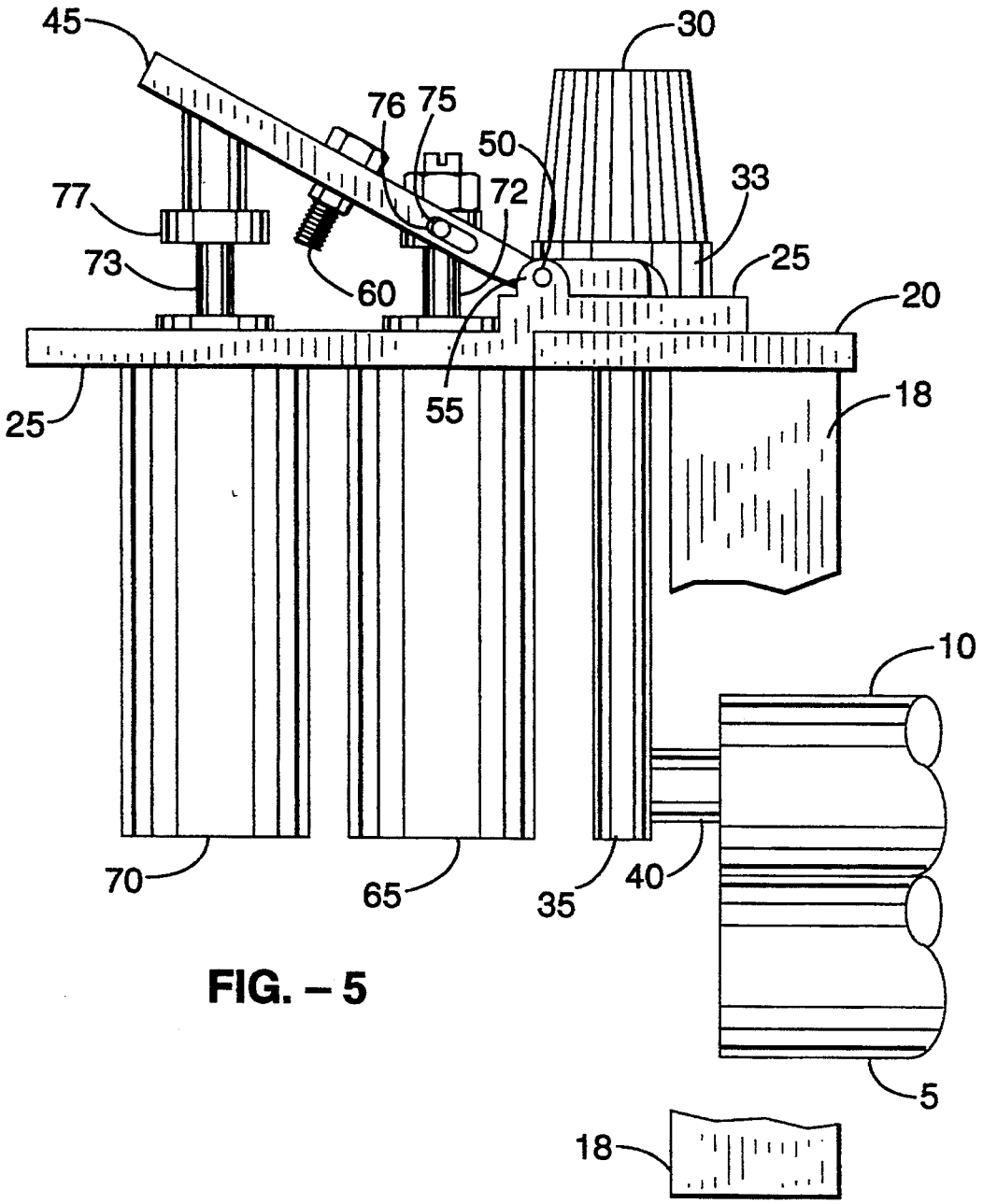
FIG. 5 is a schematic representation of a first gap position of the subject invention with both first and second actuators inactive.

Each actuator 65 and 70 has two positions for their plungers 72 and 73 (out when inactive and in when active). As seen in FIG. 5, when both the first 65 and second 70 actuators are inactive (plungers 72 and 73 out or extended by the controller) the lever 45 is positioned in a first gap setting (or a first gap setting step). In the first gap setting the lever 45 first end (the lever end nearest the linkage 35) is pulled close to the reference base by the resilient means associated with the linkage 35. At this point there is no pivoting action of the lever's first end under the notched collar 33. This first gap setting yields the narrowest dimension between the roller 5 and 10 surfaces. Usually, the first gap setting accommodates a packet with a one to five page range, however, other page count ranges can be set by adjusting the linkage 35 reference position.

Figure 6:
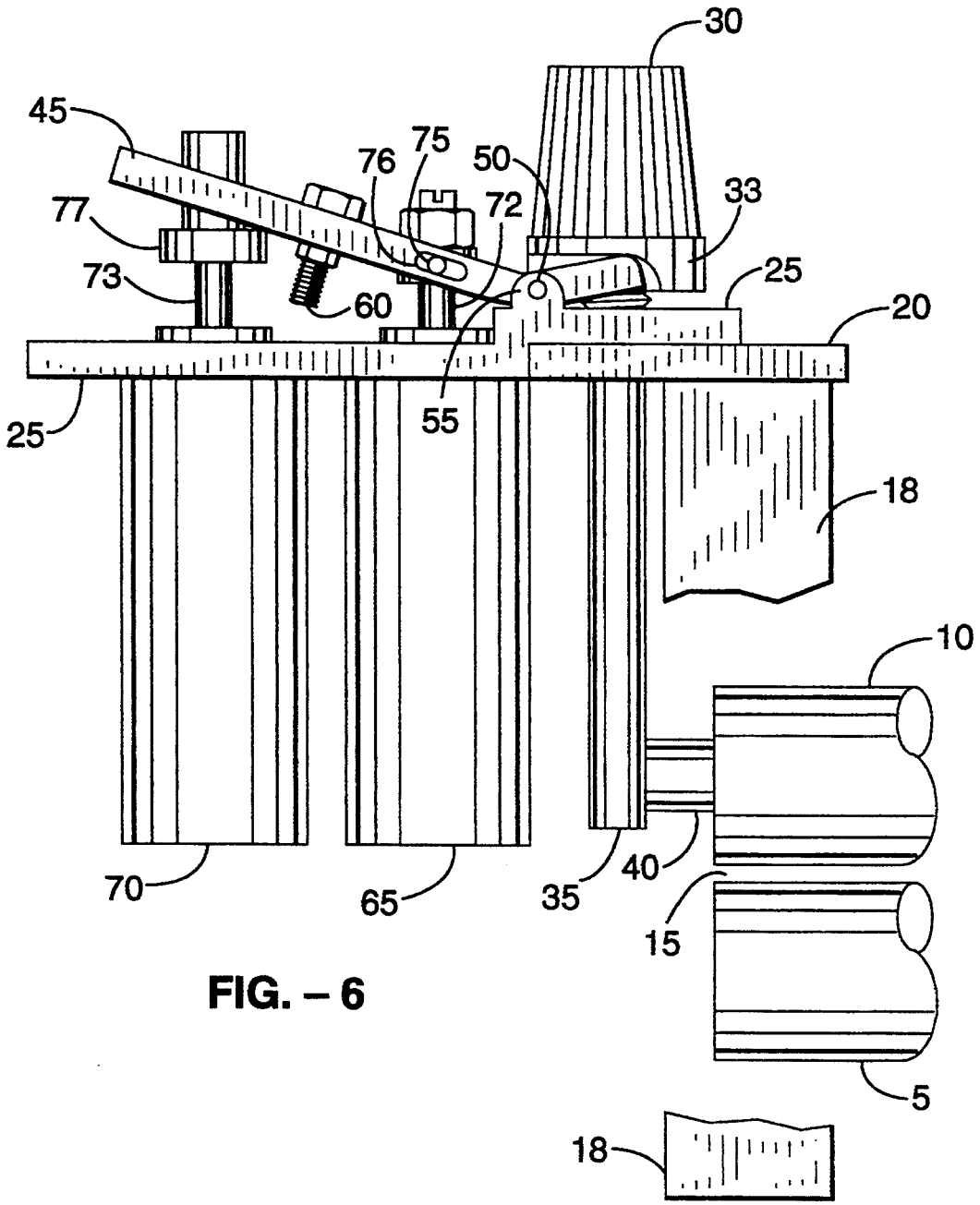
FIG. 6 is a schematic representation of a second gap position of the subject invention with the first actuator activated.

As seen in FIG. 6, when the first actuator 65 is active (first plunger 72 retracted into the actuator 65 by the controller) the lever 45 is pulled down and stopped by a plunger cap stop 77 attached to the second plunger 73. This action generates a second gap setting (or second gap setting step). In the second gap setting the lever 45 second end is pivoted away from the reference base and the notched collar 33 and associated linkage 35 move the rollers 5 and 10 further apart than in the first gap setting. The second gap setting usually accommodates a page count range of from six to ten pages, but other ranges are possible.

Figure 7:
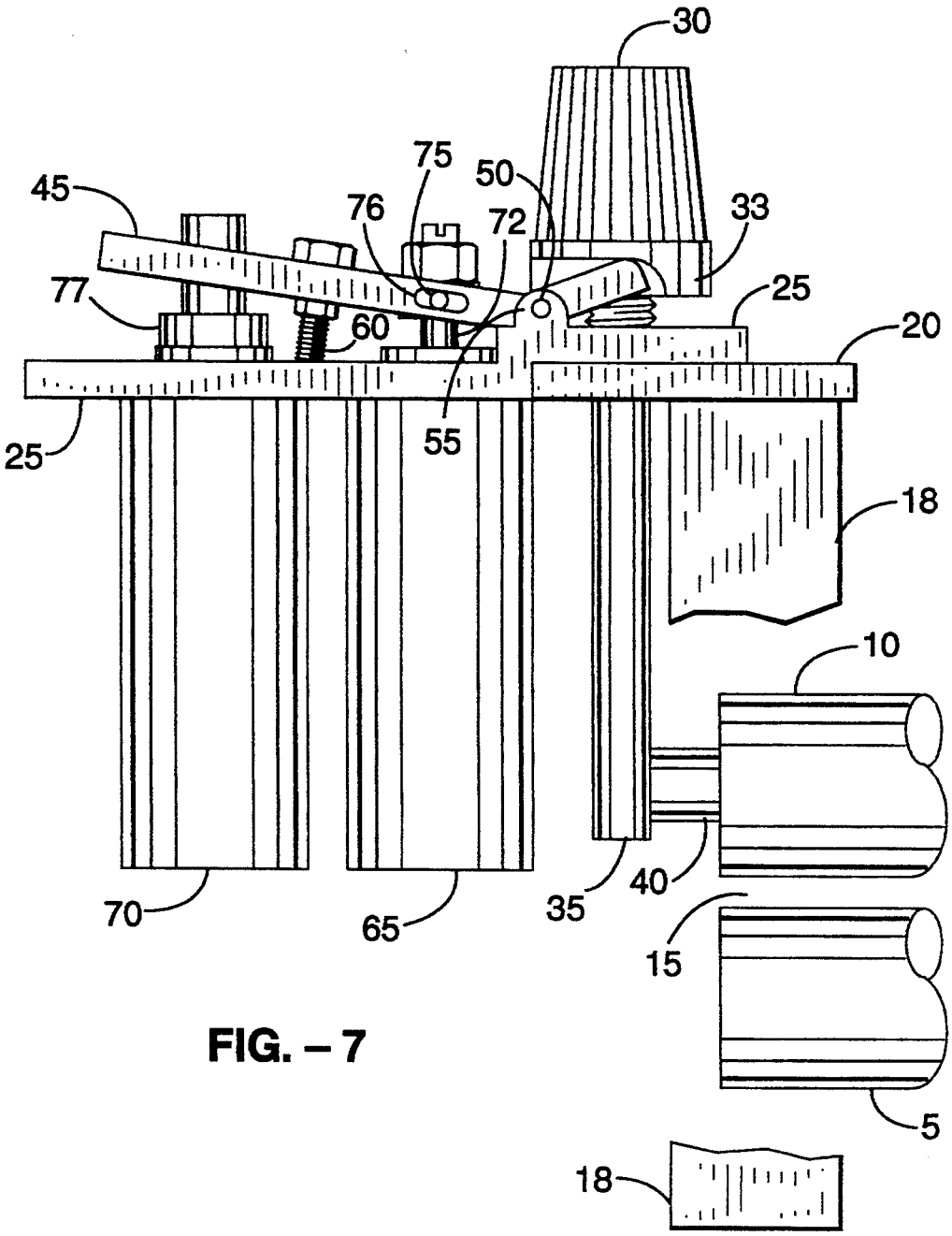
FIG. 7 is a schematic representation of a third gap position of the subject invention with the second actuator activated.

Finally, in FIG. 7 is shown a third gap setting (or third gap setting step) in which the first and second actuators 65 are active (first plunger 72 retracted into the actuator 65 by the controller and second plunger 73 retracted into the actuator 70 by the controller) and the lever first end is positioned at a maximum distance away from the reference base with the notched collar 33 displaced away from the reference base. With both plungers 72 and 73 retracted, the plunger cap stop 77 no longer blocks the lowering on the lever 45 second end. The third gap setting usually accommodates a packet with a page count range of from eleven to fifteen pages, but other page count ranges are possible.

It is once again noted that the linkage 35 and notched collar 33 are forced against the reference base by a spring coupled to the linkage 35 by standard means. When the lever 45 pivots, the lever first end acts against the spring to pry or lift the notched collar 33 and linkage 35 to generate the gap setting steps. Further, only two on-off actuators 65 and 70 are required to generate the three gap setting lever 45 positions and with more than two actuators associated with the lever 45 more than three lever 45 positions can be generated.

Figure 8:
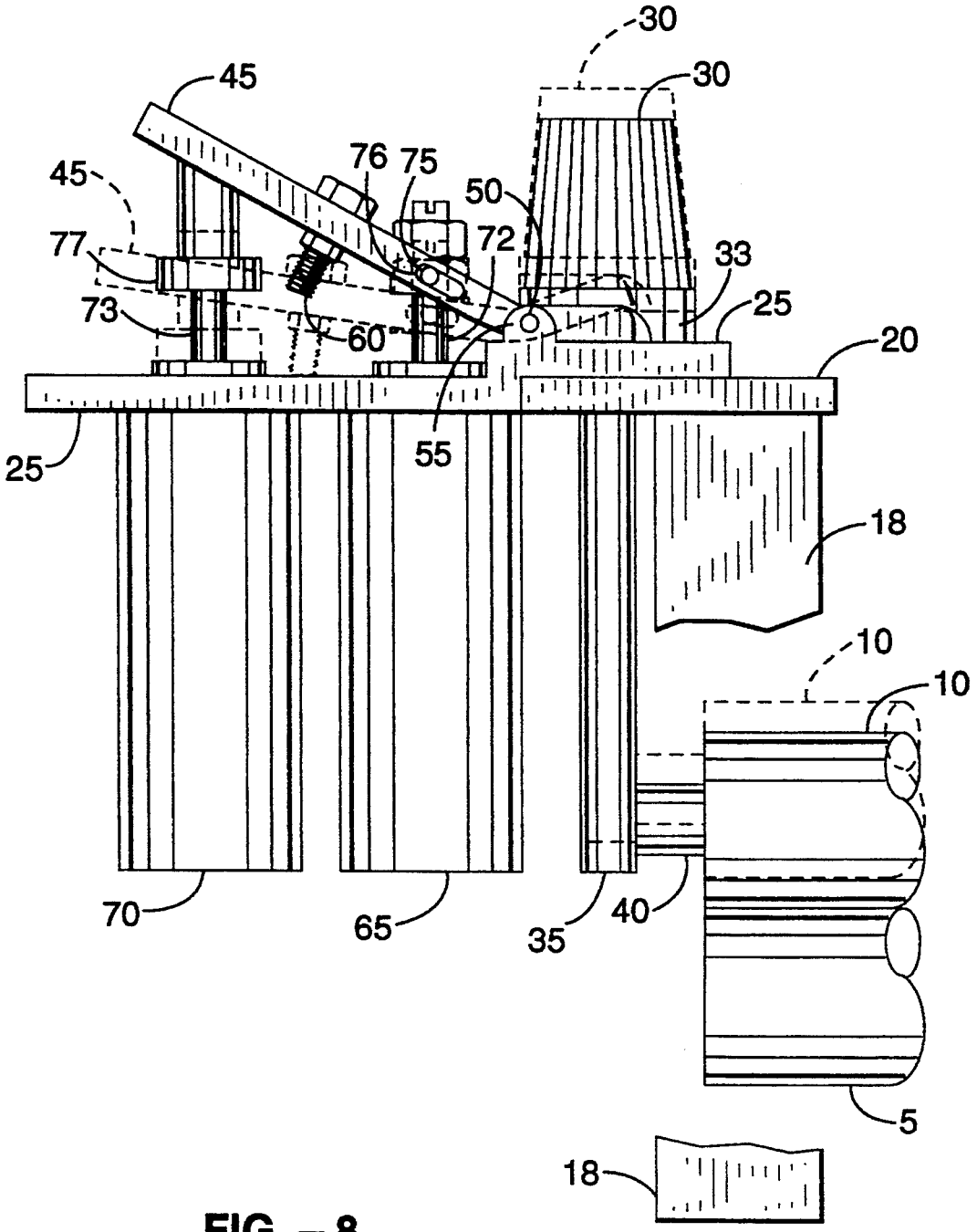
FIG. 8 is a schematic representation showing both the first gap position of FIG. 5 (dotted lines) and the third gap position of FIG. 7 (solid lines) of the subject invention.

For clarity of the lever 45 action during stepping of the gap, FIG. 8 illustrates the motion of the lever 45 between the extremes (lever up (solid lines) for narrow roller gap setting and lever down (dashed lines) for wide roller gap setting).

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. For use in transporting a packet containing from one to a plurality of pages, a dynamic roller positioning system for adjusting a packet receiving gap between two packet transporting rollers, comprising:

a) a pair of rollers with each roller having a packet contacting surface and the packet receiving gap separating said surfaces;

b) gap setting means for setting by steps said paired rollers to a selected gap dimension;

c) control means for actuating said gap setting means for each packet; and d) a database utilized by said control means, whereby said control means utilizes a page count for each packet found in said database to signal said gap setting means to produce an appropriate gap dimension to receive that said packet.

2. A dynamic roller positioning system according to claim 1, wherein said pair of rollers comprises a first roller with a fixed position for rotation and a second roller with a variable position for rotation, wherein when said second rollers position of rotation varies said gap dimension varies.

3. A dynamic roller positioning system according to claim 2, wherein said gap setting means comprises:

a) a reference base for aligning said gap setting means;

b) an adjustment lever with first and second ends and a pivot attachment point, wherein said adjustment lever is pivotally secured to said reference base at said pivot attachment point;

c) a linkage between said adjustment lever second end and said second roller, whereby when said adjustment lever pivots on said reference base said gap dimensions are set by said steps; and d) means for positioning said adjustment lever to set said gap dimensions as instructed by said control means.

4. A dynamic roller positioning system according to claim 3, wherein said linkage is slidably mounted in said reference base.

5. A dynamic roller positioning system according to claim 3, wherein said adjustment lever positioning means comprises:

a) means for setting said adjustment lever to a stop position against said reference base and b) actuator means for pivoting said adjustment lever to set said gap dimensions by said steps as instructed by said control means.

6. A dynamic roller positioning system according to claim 5, wherein said actuator means comprises a plurality of actuators secured to said reference base and positioned to exert pivoting forces on said adjustment lever proximate said adjustment lever first end.

7. A dynamic roller positioning system according to claim 5, wherein said actuator means comprises first and second actuators secured to said reference base, wherein when both said first and second actuators are inactive said adjustment lever is positioned in a first gap setting step of said rollers, when said first actuator is active said adjustment lever is pivoted to generate a second gap setting step of said rollers, and when said second actuator is active said adjustment lever is pivoted to generate a third gap setting step of said rollers.

8. A dynamic roller positioning system according to claim 5, wherein said means for setting said adjustment lever to a stop position against said reference base comprises a lockable screw mounted in said adjustable lever proximate said adjustable lever first end.

9. For use in transporting a packet containing from one to a plurality of pages, a dynamic roller positioning system for adjusting a packet receiving gap between two packet transporting rollers, comprising:

a) a housing;

b) a first roller mounted in said housing with a fixed position for rotation and having an outer packet contacting surface;

c) a second roller mounted in said housing with a variable position for rotation and having an outer packet contacting surface and a central axle with first and second ends, wherein a gap with variable dimensions separates said first and second roller outer packet contacting surfaces;

d) gap setting means for setting by steps said first and second rollers to a selected gap dimension;

e) control means for actuating said gap setting means for each packet; and f) a database utilized by said control means, whereby said control means utilizes a page count for each packet found in said database to signal said gap setting means to produce an appropriate gap dimension to receive that said packet.

10. A dynamic roller positioning system according to claim 9, wherein said gap setting means comprises:

a) a reference base for aligning said gap setting means;

b) an adjustment lever with first and second ends and a pivot attachment point, wherein said adjustment lever is pivotally secured to said reference base at said pivot attachment point;

c) a linkage between said adjustment lever second end and said second roller, whereby when said adjustment lever pivots on said reference base said gap dimensions are set; and d) means for positioning said adjustment lever to set said gap dimensions as instructed by said control means.

11. A dynamic roller positioning system according to claim 10, wherein said linkage is rigid and slidably mounted in said reference base.

12. A dynamic roller positioning system according to claim 10, wherein said adjustment lever positioning means comprises:

a) means for setting said adjustment lever to a stop position against said reference base and b) actuator means for pivoting said adjustment lever to set said gap dimensions by said steps as instructed by said control means.

13. A dynamic roller positioning system according to claim 12, wherein said actuator means comprises a plurality of actuators secured to said reference base and positioned to exert pivoting forces on said adjustment lever proximate said adjustment lever first end.

14. A dynamic roller positioning system according to claim 12, wherein said actuator means comprises first and second actuators secured to said reference base, wherein when both said first and second actuators are inactive said adjustment lever is positioned in a first gap setting step of said rollers, when said first actuator is active said adjustment lever is pivoted to generate a second gap setting step of said rollers, and when said second actuator is active said adjustment lever is pivoted to generate a third gap setting step of said rollers.

15. A dynamic roller positioning system according to claim 12, wherein said means for setting said adjustment lever to a stop position against said reference base comprises a lockable screw mounted in said adjustable lever proximate said adjustable lever first end.

16. For use in transporting a packet containing from one to a plurality of pages, a dynamic roller positioning system for adjusting a packet receiving gap between two packet transporting rollers, comprising:

a) a housing;

b) a first roller mounted in said housing with a fixed position for rotation and having an outer packet contacting surface;

c) a second roller mounted in said housing with a variable position for rotation and having an outer packet contacting surface and a central axle with first and second ends, wherein a gap with variable dimensions separates said first and second roller outer packet contacting surfaces;

d) gap setting means for setting said first and second rollers to a selected gap dimension, wherein said gap setting means comprises:

a reference base for aligning said gap setting means;

an adjustment lever with first and second ends and a pivot attachment point, wherein said adjustment lever is pivotally secured to said reference base at said pivot attachment point;

a rigid linkage between said adjustment lever second end and said second roller, whereby when said adjustment lever pivots on said reference base said gap dimensions are set; and means for positioning said adjustment lever to set said gap dimensions as instructed by a computer control means;

e) said computer control means actuating said gap setting means for each packet; and f) a database utilized by said computer control means, whereby said computer control means utilizes a page count for each packet found in said database to signal said flap setting means to produce an appropriate gap dimension to receive that said packet.

17. A dynamic roller positioning system according to claim 16, wherein said adjustment lever positioning means comprises:

a) means for setting said adjustment lever to a stop position against said reference base and b) actuator means for pivoting said adjustment lever to set said gap dimensions as instructed by said control means.

18. A dynamic roller positioning system according to claim 17, wherein said actuator means comprises a plurality of actuators secured to said reference base and positioned to exert pivoting forces on said adjustment lever proximate said adjustment lever first end.

19. A dynamic roller positioning system according to claim 17, wherein said actuator means comprises first and second actuators secured to said reference base, wherein when both said first and second actuators are inactive said adjustment lever is positioned in a first gap setting of said rollers, when said first actuator is active said adjustment lever is pivoted to generate a second gap setting of said rollers, and when said second actuator is active said adjustment lever is pivoted to generate a third gap setting of said rollers.

* * * * *